US012359323B2

(12) United States Patent
Chen et al.

(10) Patent No.: US 12,359,323 B2
(45) **Date of Patent: *Jul. 15, 2025**

(54) SEAWATER ELECTROLYSIS ENABLES $Mg(OH)_2$ PRODUCTION AND $CO_2$ MINERALIZATION

(71) Applicant: The Regents of the University of California, Oakland, CA (US)

(72) Inventors: Xin Chen, Los Angeles, CA (US); Erika Callagon La Plante, Los Angeles, CA (US); Gaurav Sant, Los Angeles, CA (US); David Jassby, Los Angeles, CA (US); Dante Adam Simonetti, Los Angeles, CA (US); Thomas Traynor, Los Angeles, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/592,870

(22) Filed: Mar. 1, 2024

(65) Prior Publication Data

US 2024/0360567 A1 Oct. 31, 2024

Related U.S. Application Data

(63) Continuation of application No. 17/968,596, filed on Oct. 18, 2022, now Pat. No. 11,920,246.
(Continued)

(51) Int. Cl.
*C25B 1/20* (2006.01)
*C25B 9/19* (2021.01)
(Continued)

(52) U.S. Cl.
CPC ..... *C25B 1/20* (2013.01); *C25B 9/19* (2021.01); *C25B 9/30* (2021.01); *C25B 11/03* (2013.01);
(Continued)

(58) Field of Classification Search
CPC ..... C02F 1/4602
See application file for complete search history.

(56) References Cited

U.S. PATENT DOCUMENTS 2,794,776 A 6/1957 Briggs
3,655,537 A 4/1972 Russell et al.
(Continued)

FOREIGN PATENT DOCUMENTS

CN 1047040 A 11/1990
CN 1137575 A 12/1996
(Continued)

OTHER PUBLICATIONS

Bang et al., "CO2 Mineralization Using Brine Discharged from a Seawater Desalination Plant," Abstract, Minerals, Vo.7, No. 207, Oct. 30, 2017, pp. 1-12.
(Continued)

*Primary Examiner* — Harry D Wilkins, III
(74) *Attorney, Agent, or Firm* — Foley Hoag LLP; David P. Halstead; Alexander J. Chatterley

(57) ABSTRACT

A method for producing one or more hydroxide solids includes providing a catholyte comprising an electrolyte solution; contacting the catholyte with an electroactive mesh cathode to electrolytically generate hydroxide ions, thereby precipitating the one or more hydroxide solid(s); and removing the one or more hydroxide solids from the surface of the mesh where they may deposit.

26 Claims, 6 Drawing Sheets

Related U.S. Application Data

(60) Provisional application No. 63/256,888, filed on Oct. 18, 2021.

(51) Int. Cl.

| | |
|---|---|
| ***C25B 9/30*** | (2021.01) |
| ***C25B 11/03*** | (2021.01) |
| ***C25B 11/046*** | (2021.01) |
| ***C25B 13/08*** | (2006.01) |
| ***C25B 15/08*** | (2006.01) |

(52) U.S. Cl.
CPC ..... *C25B 11/046* (2021.01); *C25B 13/08* (2013.01); *C25B 15/081* (2021.01)

(56) References Cited

U.S. PATENT DOCUMENTS

| | | | | |
|---|---|---|---|---|
| 3,725,259 | A | 4/1973 | De Pree | |
| 3,790,464 | A | 2/1974 | Greaves | |
| 4,069,117 | A | 1/1978 | Cooper | |
| 4,331,525 | A | 5/1982 | Huba et al. | |
| 4,671,863 | A | 6/1987 | Tejeda | |
| 5,043,017 | A | 8/1991 | Passaretti | |
| 5,171,409 | A | 12/1992 | Barnier et al. | |
| 5,362,460 | A | 11/1994 | Laird | |
| 5,543,034 | A | 8/1996 | Hilbertz et al. | |
| 6,228,161 | B1 | 5/2001 | Drummond | |
| 7,572,750 | B2 | 8/2009 | Chen et al. | |
| 9,403,154 | B2 | 8/2016 | MacFarlane et al. | |
| 9,708,719 | B2 | 7/2017 | Swiegers et al. | |
| 9,732,431 | B2 | 8/2017 | Mozer | |
| 9,790,603 | B2 | 10/2017 | MacFarlane et al. | |
| 9,871,255 | B2 | 1/2018 | Swiegers et al. | |
| 9,938,627 | B2 | 4/2018 | Winther-Jensen et al. | |
| 10,026,967 | B2 | 7/2018 | Swiegers et al. | |
| 10,087,536 | B2 | 10/2018 | Winther-Jensen et al. | |
| 10,297,834 | B2 | 5/2019 | Swiegers et al. | |
| 10,355,283 | B2 | 7/2019 | Swiegers et al. | |
| 10,428,431 | B2 | 10/2019 | Swiegers et al. | |
| 10,577,700 | B2 | 3/2020 | Winther-Jensen et al. | |
| 10,637,068 | B2 | 4/2020 | Swiegers et al. | |
| 11,005,117 | B2 | 5/2021 | Seymour et al. | |
| 11,018,345 | B2 | 5/2021 | Swiegers et al. | |
| 11,040,898 | B2 | 6/2021 | Sant et al. | |
| 11,413,578 | B2 | 8/2022 | Sant et al. | |
| 11,465,925 | B1 * | 10/2022 | Millar, V | C01F 5/24 |
| 11,601,040 | B2 | 3/2023 | Seymour | |
| 11,682,783 | B2 | 6/2023 | Seymour et al. | |
| 11,827,542 | B2 | 11/2023 | Sant et al. | |
| 11,920,246 | B2 * | 3/2024 | Chen | C25B 15/081 |
| 12,030,016 | B2 | 7/2024 | Cohen-Cole et al. | |
| 12,080,928 | B2 | 9/2024 | Seymour et al. | |
| 12,161,972 | B2 | 12/2024 | Sant et al. | |
| 2002/0179435 | A1 | 12/2002 | Maddan | |
| 2003/0213937 | A1 | 11/2003 | Yaniv | |
| 2004/0253417 | A1 | 12/2004 | Sekoguchi et al. | |
| 2005/0011770 | A1 | 1/2005 | Katsuyoshi et al. | |
| 2005/0180910 | A1 | 8/2005 | Park | |
| 2005/0242032 | A1 | 11/2005 | Sugito et al. | |
| 2007/0261557 | A1 | 11/2007 | Gadkaree et al. | |
| 2009/0001020 | A1 | 1/2009 | Constantz | |
| 2009/0013742 | A1 | 1/2009 | Zhang | |
| 2009/0056707 | A1 | 3/2009 | Foody et al. | |
| 2009/0214408 | A1 | 8/2009 | Blake et al. | |
| 2010/0034724 | A1 | 2/2010 | Keith et al. | |
| 2010/0135882 | A1 | 6/2010 | Constantz et al. | |
| 2010/0150802 | A1 | 6/2010 | Gilliam et al. | |
| 2010/0150803 | A1 | 6/2010 | Lin | |
| 2010/0260653 | A1 | 10/2010 | Jones | |
| 2011/0195017 | A1 | 8/2011 | Martinez Martinez | |
| 2011/0203939 | A1 | 8/2011 | Jones | |
| 2012/0090433 | A1 | 4/2012 | Butler | |
| 2012/0156126 | A1 | 6/2012 | Blunn et al. | |
| 2012/0186492 | A1 | 7/2012 | Gane et al. | |
| 2012/0292196 | A1 | 11/2012 | Albrecht et al. | |
| 2012/0298522 | A1 | 11/2012 | Shipchandler et al. | |
| 2013/0034489 | A1 | 2/2013 | Gilliam et al. | |
| 2013/0220822 | A1 | 8/2013 | Winther-Jensen et al. | |
| 2013/0313199 | A1 | 11/2013 | Marcin et al. | |
| 2014/0151240 | A1 | 6/2014 | Bedell et al. | |
| 2015/0307400 | A1 | 10/2015 | Devenney | |
| 2016/0090656 | A1 | 3/2016 | Livni et al. | |
| 2016/0194208 | A1 | 7/2016 | Lake et al. | |
| 2016/0312370 | A1 | 10/2016 | Swiegers et al. | |
| 2016/0322649 | A1 | 11/2016 | Swiegers et al. | |
| 2016/0362800 | A1 | 12/2016 | Ren et al. | |
| 2016/0376173 | A1 | 12/2016 | Swiegers et al. | |
| 2017/0191173 | A1 | 7/2017 | Han et al. | |
| 2017/0291832 | A1 | 10/2017 | Salama et al. | |
| 2018/0363154 | A1 | 12/2018 | Swiegers et al. | |
| 2018/0371630 | A1 | 12/2018 | Swiegers et al. | |
| 2019/0006695 | A1 | 1/2019 | Swiegers et al. | |
| 2019/0256991 | A1 | 8/2019 | Swiegers et al. | |
| 2019/0305688 | A1 | 10/2019 | Seymour | |
| 2019/0329176 | A1 | 10/2019 | Lu et al. | |
| 2019/0367390 | A1 | 12/2019 | Sant et al. | |
| 2020/0083541 | A1 | 3/2020 | Swiegers et al. | |
| 2020/0122090 | A1 | 4/2020 | Kitaura et al. | |
| 2020/0161720 | A1 | 5/2020 | Swiegers et al. | |
| 2020/0385280 | A1 | 12/2020 | Dai et al. | |
| 2021/0001270 | A1 | 1/2021 | Lu et al. | |
| 2021/0123146 | A1 | 4/2021 | Berlinguette et al. | |
| 2021/0188671 | A1 | 6/2021 | Sant et al. | |
| 2021/0308623 | A1 | 10/2021 | Sorimachi | |
| 2021/0363651 | A1 | 11/2021 | Seymour et al. | |
| 2022/0040639 | A1 | 2/2022 | Sant et al. | |
| 2022/0176311 | A1 | 6/2022 | Omosebi et al. | |
| 2022/0267159 | A1 | 8/2022 | Shi et al. | |
| 2023/0019754 | A1 * | 1/2023 | Sant | B01D 53/78 |
| 2023/0051291 | A1 | 2/2023 | Sano et al. | |
| 2023/0058065 | A1 | 2/2023 | Sant et al. | |
| 2023/0124711 | A1 | 4/2023 | Chen et al. | |
| 2023/0125242 | A1 | 4/2023 | Sant et al. | |
| 2024/0123400 | A1 | 4/2024 | Cohen-Cole et al. | |
| 2024/0124336 | A1 * | 4/2024 | Ruan | C02F 1/4693 |
| 2024/0238721 | A1 | 7/2024 | Cohen-Cole et al. | |
| 2024/0342649 | A1 | 10/2024 | La Plante et al. | |
| 2025/0002385 | A1 * | 1/2025 | Vogt | C25B 11/052 |
| 2025/0128208 | A1 | 4/2025 | Sant et al. | |

FOREIGN PATENT DOCUMENTS

| | | | |
|---|---|---|---|
| CN | 101264406 | A | 9/2008 |
| CN | 102794093 | A | 11/2012 |
| CN | 102899679 | A | 1/2013 |
| CN | 101835727 | B | 8/2013 |
| CN | 103966622 | A | 8/2014 |
| CN | 104261449 | A | 1/2015 |
| CN | 107201443 | A | 9/2017 |
| CN | 107268027 | A | 10/2017 |
| CN | 107311339 | A | 11/2017 |
| CN | 108434893 | A | 8/2018 |
| CN | 207699684 | U | 8/2018 |
| CN | 112981428 | A | 6/2021 |
| CN | 113005471 | A | 6/2021 |
| DE | 4326757 | A1 | 2/1994 |
| EP | 1519225 | A2 | 3/2005 |
| EP | 3673972 | A1 | 7/2020 |
| GB | 823531 | A | 11/1959 |
| GB | 2629489 | A | 10/2024 |
| IE | 922650 | A1 | 3/1994 |
| JP | H1053413 | A | 2/1998 |
| JP | 2003-326155 | A | 11/2003 |
| JP | 2014/157147 | A | 8/2014 |
| KR | 2009/0010425 | A | 1/2009 |
| SU | 904368 | A1 | 8/1983 |
| WO | WO-87/01108 | A1 | 2/1987 |
| WO | WO-2006/034339 | A1 | 3/2006 |
| WO | WO-2008/089523 | A1 | 7/2008 |
| WO | WO-2009/039445 | A2 | 3/2009 |
| WO | WO-2009/128297 | A1 | 10/2009 |
| WO | WO-2011/075680 | A1 | 6/2011 |
| WO | WO-2012/095659 | A1 | 7/2012 |

(56) References Cited

FOREIGN PATENT DOCUMENTS

| | | | |
|---|---|---|---|
| WO | WO-2014/042781 | A2 | 3/2014 |
| WO | WO-2014/042782 | A1 | 3/2014 |
| WO | WO-2014/089443 | A1 | 6/2014 |
| WO | WO-2014/168584 | A1 | 10/2014 |
| WO | WO-2015/106820 | A1 | 7/2015 |
| WO | WO-2016/028023 | A1 | 2/2016 |
| WO | WO-2017/100840 | A1 | 6/2017 |
| WO | WO-2017/100841 | A1 | 6/2017 |
| WO | WO-2017/100847 | A1 | 6/2017 |
| WO | WO-2018/218294 | A1 | 12/2018 |
| WO | WO-2019/006352 | A1 | 1/2019 |
| WO | WO-2021/061213 | A2 | 4/2021 |
| WO | WO-2021/097518 | A1 | 5/2021 |
| WO | WO-2021/117934 | A1 | 6/2021 |
| WO | WO-2022115955 | A1 | 6/2022 |
| WO | WO-2023/278423 | A1 | 1/2023 |
| WO | WO-2023/069777 | A1 | 4/2023 |
| WO | WO-2023/069947 | A2 | 4/2023 |
| WO | WO-2023/114474 | A2 | 6/2023 |
| WO | WO-2023/175605 | A1 | 9/2023 |
| WO | WO-2023/175606 | A1 | 9/2023 |
| WO | WO-2023/181794 | A1 | 9/2023 |
| WO | WO-2024/077053 | A1 | 4/2024 |
| WO | WO-2024/250020 | A2 | 12/2024 |

OTHER PUBLICATIONS

Bisercic et al., "Ultrasound and schacking-assisted water-leaching of anions and cations from fly ash" Journal of the Serrbian Chemical Society,. vol. 81, Iss 7 : pp. 813-827 (2016).
Carré et al., "Electrochemical calcerous deposition in seawater." A review, Environmental Chemistry Letters, vol. 18, Apr. 2020, pp. 1193-1208.
Deng et al., "Current efficiency of synthesis magnesium hydroxide nanoparticles via electrodeposition", 3rd International Conference on Material, Mechanical and Manufacturing Engineering, Atlantis Press, (2015).
Extended European Search Report for EP Application No. 20867650.2 dated Sep. 12, 2023.
Extended European Search Report for EP Application No. 24153508.7 dated Jun. 6, 2024.
International Search Report and Written Opinion for International Application No. PCT/US2020/037629 dated Mar. 25, 2021.
International Search Report and Written Opinion for International Application No. PCT/US2022/0478585 dated Mar. 28, 2023.
International Search Report and Written Opinion for International Application No. PCT/US2022/078300 dated May 23, 2023.
International Search Report and Written Opinion for International Application No. PCT/US22/35289 dated Oct. 27, 2022.
Karoui et al, Electrochemical scaling of stainless steel in artificial seawater: Role of experimental conditions on CaCO3 and Mg(OH) 2 formation, Desalination, vol. 311, Feb. 2013, pp. 234-240.
Khajouei et al., "Produced water softening using high-pH catholyte from brine electrolysis: reducing chemical transportation and environmental footprints." Journal of Water Process Engineering, vol. 40, 2021, Article 101911, pp. 1-9.
La Plante et al., "Saline Water-Based Mineralization Pathway for Gigatonne-Scale CO2 Management." ACS Sustainable Chemistry & Engineering, vol. 9, Issue 3, 2021, pp. 1073-1089.
Mineral Makeup of Seawater, available online at https://web.stanford.edu/group/Urchin/mineral.html, accessed on Feb. 21, 2023.
Office Action for U.S. Appl. No. 16/431,300 dated Jan. 25, 2021.
Partial Supplementary European Search Report for Application No. EP 20867650.2, mailed Jun. 9, 2023.
Socolow et al. "Direct air capture of CO2 with chemicals: a technology assessment for the APS Panel on Public Affairs", American Physical Society, (2011).
Translation of CN 101835727 B.
Translation of CN-107201443.
Translation of CN-113005471.
Translation of CN-207699684.
Van Treeck et al., "Artificial Reefs Created by Electrolysis and Coral Transplantation: An Approach Ensuring the Compatibility of Environmental Protection and Diving Tourism, Estuarine" Coastal and Shelf Science, vol. 49, Supplement 1, Aug. 1999, pp. 75-81.
Zhang et al., "The use and optimization of stainless steel mesh cathodes in microbial electrolysis cells." International Journal of Hydrogen Energy, vol. 35, Issue 21, 2010, pp. 12020-12028.
"Ferro-nickel slag", Australian Pozzolan Association, (2020).
"Pyroxene", Common Minerals, University of Minnesota (2023).
Dinamani et al., "Electrosynthesis of Mg (OH) 2 coatings on stainless steel substrates." Journal of applied electrochemistry 34 (2004): 899-902.
Yang et al., "Dual-skin layer nanofiltration membranes for highly selective Li+/Mg2+ separation." Journal of Membrane Science 620 (2021): 118862.
Zhang et al., "Hectorite: Synthesis, modification, assembly and applications." Applied Clay Science 177 (2019): 114-138.
Zhao et al., "Preparation of magnesium hydroxide from serpentinite by sulfuric acid leaching for CO2 mineral carbonation." Minerals Engineering 79 (2015): 116-124.

* cited by examiner

SEAWATER ELECTROLYSIS ENABLES $Mg(OH)_2$ PRODUCTION AND $CO_2$ MINERALIZATION

CROSS-REFERENCE TO RELATED APPLICATIONS

This application is a continuation of U.S. patent application Ser. No. 17/968,596, filed Oct. 18, 2022, which claims the benefit of priority to U.S. Provisional Application No. 63/256,888, filed on Oct. 18, 2021. The contents of each of these applications is hereby incorporated by reference in their entirety.

STATEMENT OF GOVERNMENT SUPPORT

This invention was made with government support under Contract No. DE-FE0031705 awarded by the Department of Energy. The government has certain rights in the invention.

BACKGROUND OF THE INVENTION

Ocean carbon storage is a pathway for reducing atmospheric carbon concentrations. The oceans represent a vast reservoir of about 38,000 gigatonnes of carbon[1], stored in a dissolved form as $H_2CO_3$, $HCO_3^-$, and $CO_3^{2-}$ species. Carbon capture from oceans via the formation of divalent metal carbonate solids from ocean water has the potential to decrease its carbon storage capacity due to a pH reduction from this process. But an increase in the pH of ocean water may increase this storage capacity in accordance with Henry's law (see, e.g., FIG. 1A, showing a plot of seawater $CO_2$ uptake with respect to pH). Accordingly, the addition of alkaline materials, such as metal hydroxides, to ocean water has the potential to increase its pH, thereby restoring its carbon storage capacity.

Brucite ($Mg(OH)_2$) for industrial uses can be obtained either naturally, through the hydration of MgO produced from calcining magnesium carbonate, or by precipitation from seawater by the provision of alkalinity. Ocean water contains a high amount of $Mg^{2+}$ ions, particularly in the form of chloride and sulfate salts. Thus, ocean water can be a source for brucite production. There is a need for efficient methods of forming brucite from ocean water. There is further a need for methods of increasing pH of ocean water, particularly as a part of carbon capture methods.

SUMMARY

The present disclosure relates to methods for producing hydroxide solids, particularly $Mg(OH)_2$ solids. In some embodiments, the present disclosure provides a method for producing one or more hydroxide solids, the method comprising:

providing a catholyte comprising an electrolyte solution;

contacting the catholyte with an electroactive mesh cathode to electrolytically generate hydroxide ions, thereby precipitating the one or more hydroxide solids.

In some embodiments, the electrolyte solution comprises divalent metal cations. In certain embodiments, the electrolyte solution comprises Mg2+, Ca2+, or both Mg2+ and Ca2+ ions. In particularly preferred embodiments, the divalent cations comprise Mg2+ ions.

In certain embodiments, wherein the electrolyte solution comprises a brine or sea water. Preferably, the electrolyte solution comprises sea water.

In certain embodiments, the brine or sea water comprises NaCl in the brine or sea water in a concentration about 1,000 ppm or more, about 2,000 ppm or more, about 3,000 ppm or more, about 4,000 ppm or more, about 5,000 ppm or more, about 6,000 ppm or more, about 7,000 ppm or more, about 8,000 ppm or more, about 9,000 ppm or more, about 10,000 ppm or more, about 15,000 ppm or more, about 20,000 ppm or more, about 25,000 ppm or more, or about 30,000 ppm or more, about 35,000 ppm or more, about 40,000 ppm or more, about 45,000 ppm or more, about 50,000 ppm or more, about 55,000 ppm or more, or about 60,000 ppm or more. Preferably, the NaCl concentration is about 35,000 or more.

In certain embodiments, the electrolyte solution has a Ca-equivalent or Mg-equivalent concentration of about 2 ppm or more, about 10 ppm or more, about 50 ppm or more, about 100 ppm or more, about 200 ppm or more, about 300 ppm or more, about 400 ppm or more, about 500 ppm or more, about 600 ppm or more, about 700 ppm or more, about 800 ppm or more, about 900 ppm or more, about 1000 ppm or more, about 11 ppm or more, about 1200 ppm or more, about 1300 ppm or more, about 1400 ppm or more, or about 1500 ppm or more. Preferably, the electrolyte solution has an Mg-equivalent concentration of about 1000 ppm or more.

In some embodiments, the one or more hydroxide solids comprises $Mg(OH)_2$, $Ca(OH)_2$, or both $Mg(OH)_2$ and $Ca(OH)_2$. Preferably, the one or more hydroxide solids comprise $Mg(OH)_2$.

In some embodiments, the electroactive mesh cathode comprises a rotating disc cathode. In particular embodiments, the rotating disc cathode has an electroactive mesh disposed thereon.

In some embodiments, the method further comprises removing the one or more hydroxide solids from the surface of the mesh. In particular embodiments, the removing the one or more hydroxide solids from the surface of the mesh comprises scraping the surface of the mesh.

In some embodiments where the cathode is a rotating disc cathode, removing the one or more hydroxide solids from the surface of the mesh comprises rotating the rotating disc cathode past a scraper.

In certain embodiments, the electroactive mesh cathode comprises a metallic composition, non-metallic composition, or hybrid metallic and non-metallic composition.

In some embodiments, the electroactive mesh cathode comprises stainless steel, titanium oxide, carbon nanotubes, one or more polymers, graphite, or combinations thereof.

Preferably, the mesh cathode comprises stainless steel.

In some embodiments, the electroactive mesh comprises pores having a diameter in the range of about 0.1 μm to about 10000 μm.

In some embodiments, the method comprises forming alkalized effluents having a pH greater than 9, or in other embodiments, greater than 10.

In some embodiments, the anolyte comprises an acid. In certain embodiments, the acid has a pH of less than about 6.

In some embodiments, the method further comprises providing a barrier to separate the catholyte and the anolyte. In some embodiments, the barrier comprises a polymer, such as cellulose, polyvinyl chloride, organic rubber, polyolefin, polyethylene, polypropylene, or any combination thereof.

In other embodiments, the method further comprises cycling the anolyte to a neutralization pool. The neutralization pool may comprise mafic materials, ultramafic materials, calcium-rich fly ash, slag, or any combination thereof.

In some embodiments, the electrolytically generating of hydroxide ions is conducted at a current density of greater than 50 $\mu A/cm^2$.

DETAILED DESCRIPTION

The process according to the present disclosure is based on electrochemically enhanced electrolysis reactions to form brucite ($Mg(OH)_2$) precipitates in order to increase ocean alkalinity and promote atmospheric carbon dioxide dissolution. Such processes include, but are not limited to, those disclosed in International Application No. PCT/US22/35289 filed on Jun. 28, 2022, International Application PCT/US20/37629 filed on Jun. 12, 2020, and U.S. application Ser. No. 17/722,036 filed on Apr. 15, 2022, the entireties of which are hereby incorporated by reference herein.

Figure 1A:
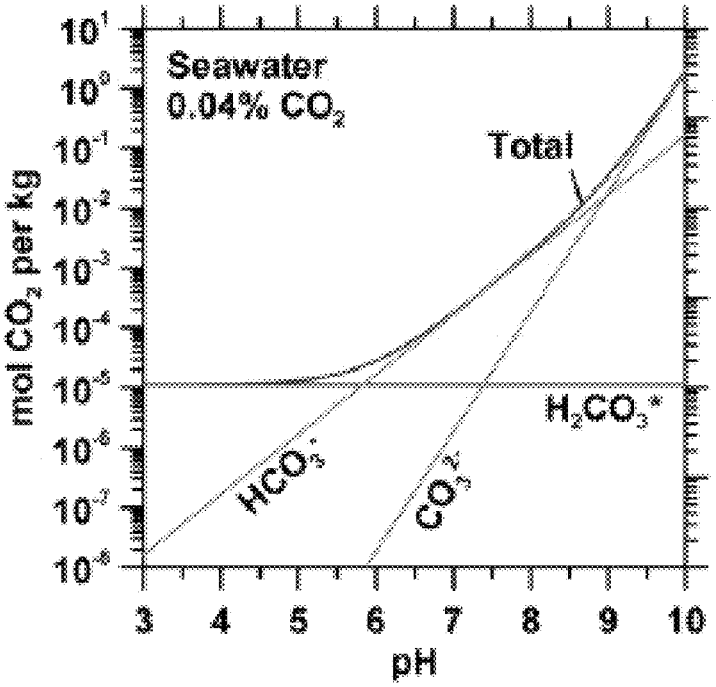
FIG. 1A is a plot of seawater $CO_2$ uptake capacity with respect to pH.

As shown in FIG. 1A, increasing the pH of seawater increases its carbon storage capacity according to the equilibrium constants describing the speciation of $H_2CO_3$, $HCO_3$, and $CO_3^{2-}$ ions and Henry's Law. In particular, the dissolution of alkaline (e.g., calcium- and magnesium-rich) solids in the ocean surface could advantageously increase its pH, allowing additional $CO_2$ uptake. The $CO_2$ uptake (quantified as a mass of $CO_2$ incorporated into solid products or as dissolved ions per mass of initial solid or liquid material) describes the material's efficiency in sequestering gaseous $CO_2$ in stable solids or dissolved ions. Enhancing $CO_2$ uptake allows impactful removal of gaseous $CO_2$ resulting from anthropogenic sources.

Figure 1B:
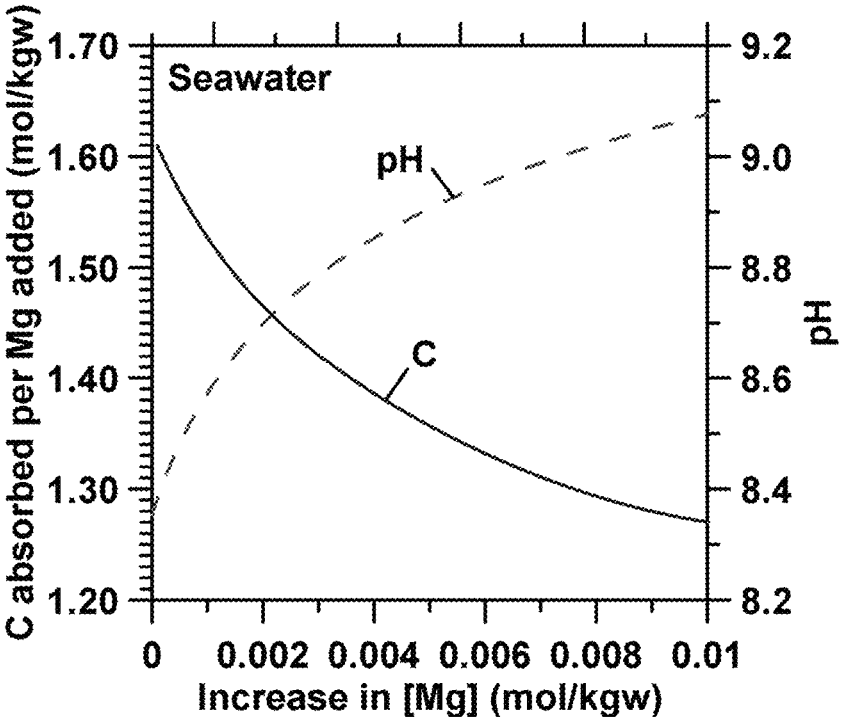
FIG. 1B is a plot of the enhancement of seawater's $CO_2$ uptake capacity by $Mg(OH)_2$ dissolution.

As shown in FIG. 1B, brucite ($Mg(OH)_2$) may be added in seawater to equilibrium which results in a pH of 9.1, equivalent to about a threefold increase in the total dissolved $CO_2$, compared to that at pH of 8.2, which is the typical pH of seawater. Brucite for industrial uses can be obtained either naturally, e.g., through the hydration of MgO produced from calcining magnesium carbonate, or by precipitation from seawater by the provision of alkalinity. FIG. 1B illustrates $CO_2$ uptake capacity enhanced by brucite dissolution. Every mole of dissolved brucite can promote about 1.6 moles of atmospheric $CO_2$ absorption.

In the present disclosure, metal hydroxide solids, such as brucite, may be produced by an electrochemical process that uses seawater, which contains ~55 mmol Mg/L, or using other Mg-rich brines as feeds. In some embodiments, a membrane-less reactor may be used to produce brucite precipitates. Advantages of such a membrane-less reactor may include lower energy requirements, reduced maintenance and operating costs, and reduced manufacturing expense at increasing scales.

In some embodiments, a method according to the present disclosure comprises: providing a catholyte comprising an electrolyte solution; contacting the catholyte with an electroactive mesh cathode to electrolytically generate hydroxide ions, thereby precipitating the one or more hydroxide solids.

In some embodiments, the method further comprises removing the one or more hydroxide solids from the surface of the mesh where they may deposit.

A $CO_2$ mineralization process can be achieved by alkalizing a circumneutral Ca- and Mg-containing solution (e.g., seawater, alkaline metal-rich groundwater, industrial wastewater, or desalination brine). In some embodiments, the method uses a single-compartment continuous stirred-tank reactor (CSTR). Operational parameters such as voltage, current density, and hydraulic retention time ("HRT")) are chosen to minimize the hydroxylation energy intensity of the design.

Figure 2:
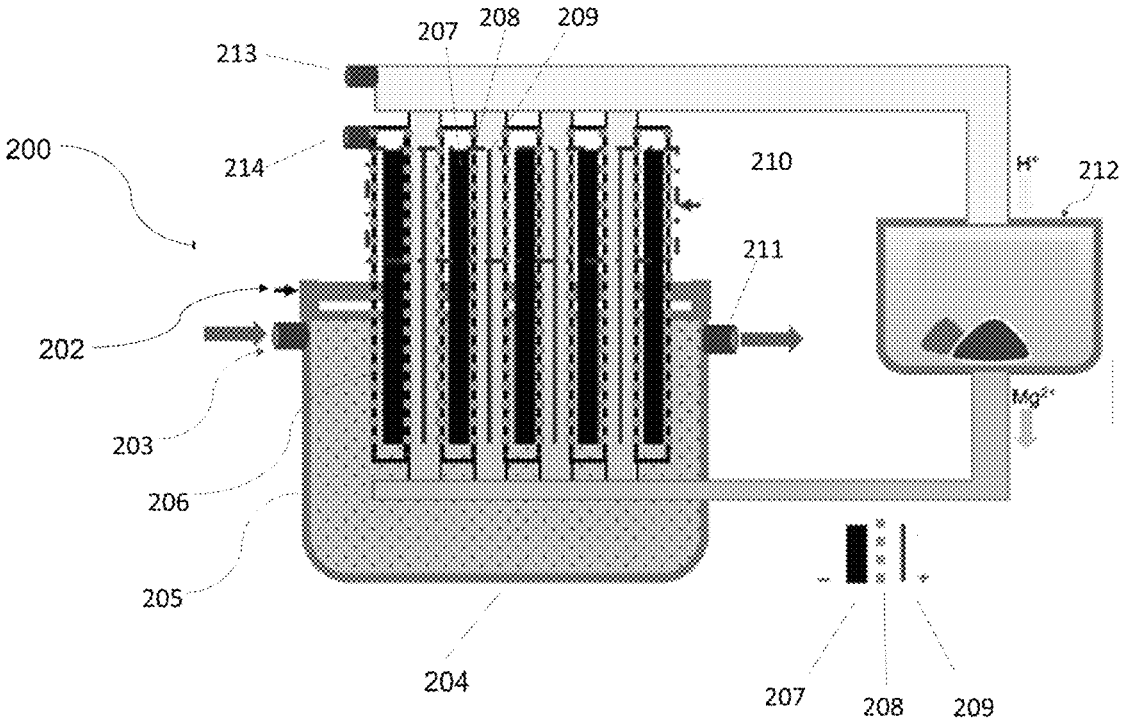
FIG. 2 is a schematic illustration of a brucite mineralization reactor, in accordance with various embodiments.

Turning to FIG. 2, a membrane-less reactor useful for practicing certain embodiments of the present invention is shown. A membrane-less electrolysis reactor 200 was conceptualized to electrochemically precipitate hydroxide solids from a catholyte. In some embodiments, a hydroxide-forming process can advantageously be achieved by alkalizing a circumneutral Ca- and Mg-containing solution, such as seawater, alkaline metal-rich groundwater, industrial wastewater, or desalination brine. We evaluated the feasibility of the conceptualized multi-compartments reactor, by using a single-compartment continuous stirred-tank reactor (CSTR). Operational parameters (e.g., voltage, current density, and hydraulic retention time ("HRT")) may also be selected to demonstrate the carbonation energy intensity of the design.

Referring still to FIG. 2, reactor 200 includes a reservoir 405 containing a catholyte, such as seawater, alkaline metal-rich groundwater, industrial wastewater, desalination brine. The reactor further includes an anolyte inlet 203 and outlet 211. Electrode assembly 206 is in fluid contact with the aqueous sequestration solution reservoir 205 and comprises rotating disk cathodes 207 and anodes 209 separated by a barrier layer 208. The rotating disc cathodes 207 (e.g. 316L stainless steel mesh) may be rotated around shaft 202 to pass a scraper 210 for product removal and collection. The reactor may further comprise a neutralization pool 212. $O_2$ may be produced at the anode 209, and may be released at an $O_2$ outlet 213. $H_2$ may be produced at the rotating disk cathode 207, and may be released at an $H_2$ outlet 214.

In embodiments comprising rotating disc cathodes, inducing the precipitation of the carbonate solid includes rotating a cylinder consisting of the electroactive mesh in the solution, while applying suction to draw the solution onto the outer surface of the mesh.

The electrolytes may be separated with a porous barrier for the following reasons: (1) minimized neutralization reactions between anolytes and catholytes allows stable cathode pH for effective mineralization; (2) separated electrolytes promote higher energy efficiency of the reactor; and (3) the gas streams ($H_2$ and $O_2$) may need to be divided and collected separately.

Referring still to FIG. 2, an online pH-monitoring system may be used, for example, to control the applied electric current to attain a constant catholyte pH or greater than 9. The anolyte can in some embodiments provide In some embodiments, the reactor includes a catholyte and an anolyte. The catholyte may be an electrolyte solution configured to flow around or through a cathode. The anolyte may be an electrolyte configured to flow around or through an anode. The catholyte may comprise an electrolyte solution.

In some embodiments, the electrolyte solution comprises divalent metal cations, such as $Mg^{2+}$, $Ca^{2+}$, or both $Mg^{2+}$ and $Ca^{2+}$ ions. In particularly preferred embodiments, the electrolyte solution comprises $Mg^{2+}$ ions.

In some embodiments, the electrolyte solution comprises seawater or a brine. Preferably, the electrolyte is seawater. In some embodiments, the electrolyte solution has a concentration of NaCl of about 1,000 ppm or more, about 2,000 ppm or more, about 3,000 ppm or more, about 4,000 ppm or more, about 5,000 ppm or more, about 6,000 ppm or more, about 7,000 ppm or more, about 8,000 ppm or more, about 9,000 ppm or more, about 10,000 ppm or more, about 15,000 ppm or more, about 20,000 ppm or more, about 25,000 ppm or more, or about 30,000 ppm or more, about 35,000 ppm or more, about 40,000 ppm or more, about 45,000 ppm or more, about 50,000 ppm or more, about 55,000 ppm or more, or about 60,000 ppm or more, or greater, or any range or value there between. In preferred embodiments, the electrolyte solution has a NaCl concentration of about 35,000 ppm or more.

In some embodiments, the catholyte has a concentration of Ca-equivalent or Mg-equivalent of about 2 ppm or more, about 10 ppm or more, about 50 ppm or more, about 100 ppm or more, about 200 ppm or more, about 300 ppm or more, about 400 ppm or more, about 500 ppm or more, about 600 ppm or more, about 700 ppm or more, about 800 ppm or more, about 900 ppm or more, about 1000 ppm or more, about 11 ppm or more, about 1200 ppm or more, about 1300 ppm or more, about 1400 ppm or more, or about 1500 ppm or more. Preferably, the catholyte solution has an Mg-equivalent concentration of about 1000 ppm or more. Ca-equivalent and Mg-equivalent refer to salts of Ca and Mg in the electrolyte solution. Preferably, the salts are chloride salts or sulfate salts.

In some embodiments, the anolyte comprises an acid. In some embodiments, the anolyte has a pH of less than about 7, less than about 6, less than about 4, less than about 3, less than about 2, down to less than about 1. In particular embodiments, the anolyte has a pH of about 1 to about 6, about 1 to about 5, about 1 to about 4, about 1 to about 3, or about 1 to about 2.

In some embodiments, the one or more hydroxide solids comprise $Mg(OH)_2$, $Ca(OH)_2$, or both $Mg(OH)_2$ and $Ca(OH)_2$. In particularly preferred embodiments, the one or more hydroxide solids comprise $Mg(OH)_2$ (also referred to herein as brucite).

In some embodiments, the cathode 207 comprises an electroactive mesh. In some embodiments, the electroactive mesh comprises a metallic or a non-metallic composition, or a combination of metallic and non-metallic compositions. In some embodiments, the electroactive mesh comprises, consists essentially of, or consists of a metallic mesh or carbon-based mesh. In some embodiments, the electroactive mesh comprises stainless steel, titanium oxide, carbon nanotubes, polymers, and/or graphite, or other hybrid compositions of these materials. Preferably, the electroactive mesh comprises stainless.

In some embodiments, the electroactive mesh comprises pores having a diameter in the range of about 0.01 μm to about 10000 μm (e.g., about 0.1, 0.2, 0.3, 0.4, 0.5, 0.6, 0.7, 0.8, 0.9, 1, 2, 3, 4, 5, 6, 7, 8, 9, 10, 20, 30, 40, 50, 60, 70, 80, 90, 100, 200, 300, 400, 500, 1000, 1500, 2000, 3000, 4000, 5000, 6000, 7000, 8000, 9000, or 10000 μm, or any range there between).

In some embodiments, the cathodes 207 are (for example, 316L stainless steel mesh) coupled with OER-(oxygen evolution reactions) selective anodes (e.g., $MnO_2$-coated Pt) to produce alkalinity and acidity.

In some embodiments, the method further comprises removing the one or more hydroxide solids from the surface of the mesh. In preferred embodiments, the one or more hydroxide solids are removed by a scraping process. The scraping process may use a metallic brush, blade, or high-pressure nozzles. In particular embodiments where the cathodes are rotating disc cathodes, the one or more hydroxide solids from the surface of the mesh may be removed from the surface of the mesh by rotating the rotating disc cathode past a scraper, In some embodiments, the reactor further comprises a barrier 208 to separate the anolyte from the catholyte. In some embodiments, the barrier comprises cellulose, polyvinyl chloride, organic rubber, polyolefin, polyethylene, polypropylene, any other suitable material, or combinations thereof. The barrier separates the catholyte and anolyte in order to: (1) minimize neutralization reactions between the anolyte and the catholyte, resulting in a stable cathode pH necessary for brucite production; (2) promote higher energy efficiency of the reactor; and (3) facilitate collection of gas streams ($H_2$ and $O_2$).

A pH-monitoring system may be used, for example, to control the applied electric current to attain a constant catholyte pH. For example, in some embodiments, the catholyte pH is maintained above 9, such as at about 9.5-9.6. The stainless steel cathodes may be covered by a hydrophobic mesh (e.g., polypropylene (PP) meshes) as hydroxide catalysts, thereby electrolytically generating hydroxide ions at the cathode. The catholyte may be seawater-flushed such that the $Mg^{2+}$ ions react with the electrolytically produced $OH^-$ ions to produce $Mg(OH)_2$. Operational parameters including current density and hydraulic retention time, and HRT may be optimized. Within a reasonable HRT (e.g., in seconds to minutes), the production of $Mg(OH)_2$ is promoted at high current densities. In some embodiments, the current density is greater than 50 $\mu A/cm^2$, greater than 100 $\mu A/cm^2$, greater than 200 $\mu A/cm^2$, greater than 300 $\mu A/cm^2$, greater than 400 $\mu A/cm^2$, or greater than 5000 $\mu A/cm^2$, or at any range therebetween. In addition, high current densities may also yield alkalinized effluents (e.g., pH greater than about 9, or greater than about 10), can advantageously be used to improve $CO_2$ capture capabilities of an anolyte source, such as seawater.

In some embodiments, PP-covered stainless steel cathodes may be rotated to pass a scraper (e.g., a metallic brush, blade, or high-pressure nozzles) to remove the hydroxides, thereby regenerating the cathode for subsequent hydroxide production as the discs rotate back into the liquid. In some embodiments, a nozzle sprayer may be used to force the detachment of the precipitated hydroxides.

In some embodiments, the anolyte is cycled to a neutralization pool 212 comprising calcium-rich fly ash, slag, or any combination thereof, and the produced acidity can thus be consumed to restore alkalinity. Ca-rich fly ashes and minerals advantageously may also be used to enrich the $Ca^{2+}$ in anolyte.

Figure 3A:
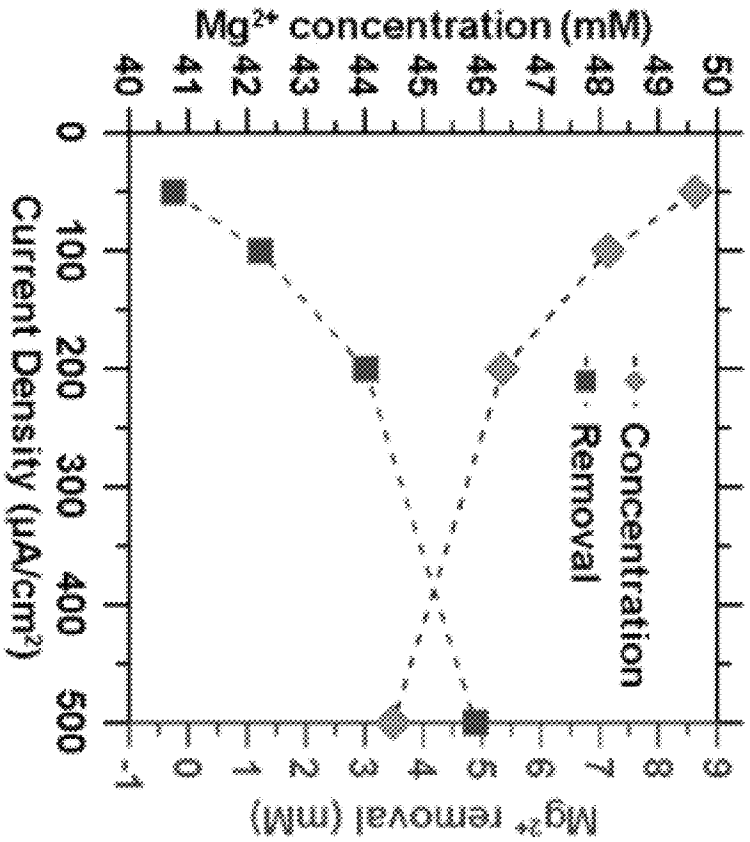
FIG. 3A is a plot of brucite production and removal rate per 1 L of seawater as a function of current densities.
Figure 3B:
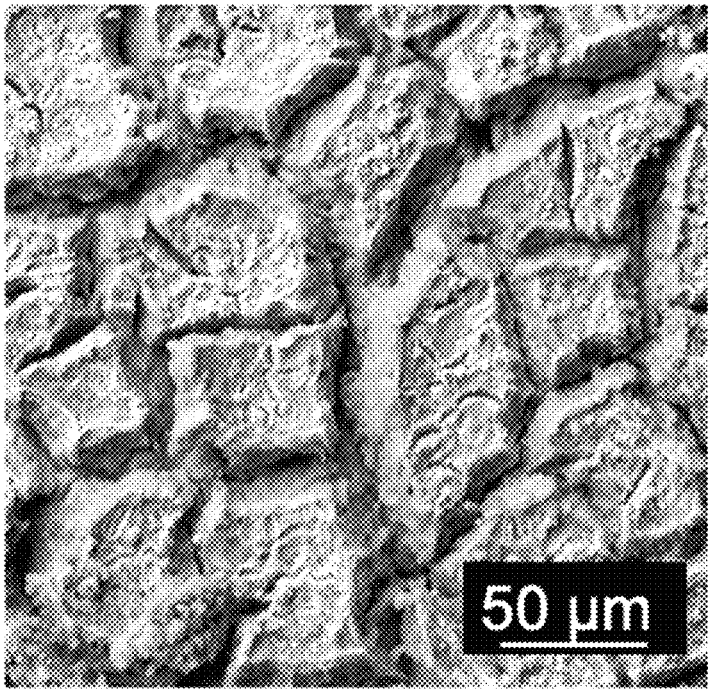
FIG. 3B is a scanning electron microscopy (SEM) image of brucite precipitates formed on a cathode.
Figure 3C:
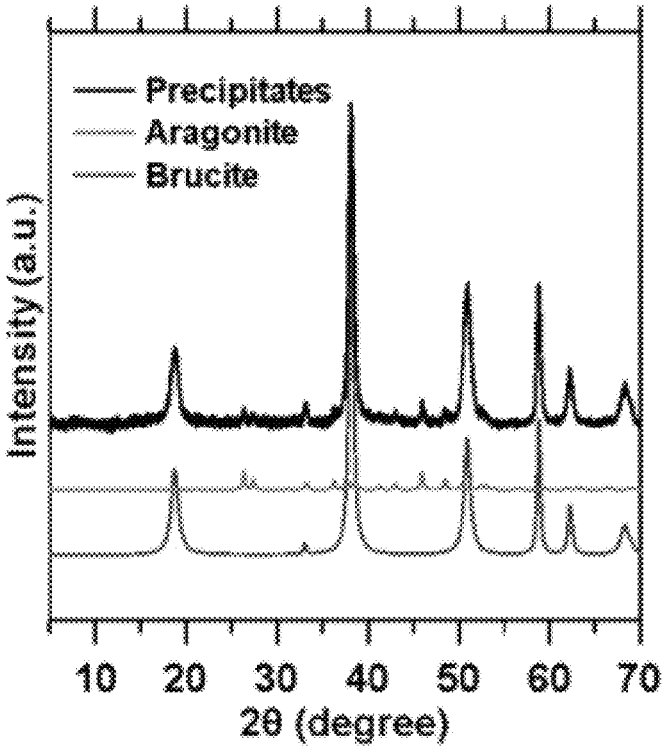
FIG. 3C is an x-ray diffraction (XRD) pattern of brucite precipitates formed on a cathode.

As shown in FIGS. 3A-C, $Mg(OH)_2$ according to certain embodiments of the present methods forms a scale at the cathode surface, permitting easy removal via a simple scraping process. FIG. 3A shows a plot of the brucite production and removal rates per L seawater as functions of the current densities. A higher current density yields a lower concentration of brucite formed and a higher removal rate. FIG. 3B shows a scanning electron microscopy (SEM) image of the brucite precipitates formed on the cathode mesh. The brucite formed is thick, brittle, and with defined cracks, which help promote easy removal. FIG. 3C shows an X-ray diffraction (XRD) plot of the precipitates formed. The XRD plot shows that brucite is formed as the same peaks are seen between the precipitates and brucite.

As used herein, the singular terms "a," "an," and "the" include plural referents unless the context clearly dictates otherwise. Thus, for example, reference to an object can include multiple objects unless the context clearly dictates otherwise.

As used herein, the term "set" refers to a collection of one or more objects. Thus, for example, a set of objects can include a single object or multiple objects.

As used herein, the terms "substantially" and "about" are used to describe and account for small variations. When used in conjunction with an event or circumstance, the terms can refer to instances in which the event or circumstance occurs precisely as well as instances in which the event or circumstance occurs to a close approximation. For example, when used in conjunction with a numerical value, the terms can encompass a range of variation of less than or equal to ±10% of that numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%.

As used herein, the term "size" refers to a characteristic dimension of an object. Thus, for example, a size of an object that is circular can refer to a diameter of the object. In the case of an object that is non-circular, a size of the non-circular object can refer to a diameter of a corresponding circular object, where the corresponding circular object exhibits or has a particular set of derivable or measurable characteristics that are substantially the same as those of the non-circular object. Alternatively, or in conjunction, a size of a non-circular object can refer to an average of various orthogonal dimensions of the object. Thus, for example, a size of an object that is an ellipse can refer to an average of a major axis and a minor axis of the object. When referring to a set of objects as having a particular size, it is contemplated that the objects can have a distribution of sizes around the particular size. Thus, as used herein, a size of a set of objects can refer to a typical size of a distribution of sizes, such as an average size, a median size, or a peak size.

Additionally, amounts, ratios, and other numerical values are sometimes presented herein in a range format. It is to be understood that such range format is used for convenience and brevity and should be understood flexibly to include numerical values explicitly specified as limits of a range, but also to include all individual numerical values or sub-ranges encompassed within that range as if each numerical value and sub-range is explicitly specified. For example, a ratio in the range of about 1 to about 200 should be understood to include the explicitly recited limits of about 1 and about 200, but also to include individual ratios such as about 2, about 3, and about 4, and sub-ranges such as about 10 to about 50, about 20 to about 100, and so forth.

While the disclosure has been described with reference to the specific embodiments thereof, it should be understood by those skilled in the art that various changes may be made and equivalents may be substituted without departing from the true spirit and scope of the disclosure as defined by the appended claims. In addition, many modifications may be made to adapt a particular situation, material, composition of matter, method, operation or operations, to the objective, spirit and scope of the disclosure. All such modifications are intended to be within the scope of the claims appended hereto. In particular, while certain methods may have been described with reference to particular operations performed in a particular order, it will be understood that these operations may be combined, sub-divided, or re-ordered to form an equivalent method without departing from the teachings of the disclosure. Accordingly, unless specifically indicated herein, the order and grouping of the operations is not a limitation of the disclosure.

The embodiments, illustratively described herein may suitably be practiced in the absence of any element or elements, limitation or limitations, not specifically disclosed herein. Thus, for example, the terms "comprising," "including," "containing," etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

REFERENCES

1. Renforth, P.; Henderson, G. Assessing Ocean Alkalinity for Carbon Sequestration. *Rev. Geophys.* 2017, 55 (3), 636-674. https://doi.org/10.1002/2016RG000533.
2. Kheshgi, H. S. Sequestering Atmospheric Carbon Dioxide by increasing Ocean Alkalinity. *Energy* 1995, 20 (9), 915-922. https://doi.org/10.1016/0360-5442(95)00035-F.

INCORPORATION BY REFERENCE

All publications and patents mentioned herein are hereby incorporated by reference in their entirety as if each individual publication or patent was specifically and individually indicated to be incorporated by reference. In case of conflict, the present application, including any definitions herein, will control.

EQUIVALENTS

While specific embodiments of the subject invention have been discussed, the above specification is illustrative and not restrictive. Many variations of the invention will become apparent to those skilled in the art upon review of this specification and the claims below. The full scope of the invention should be determined by reference to the claims, along with their full scope of equivalents, and the specification, along with such variations.

The invention claimed is:

1. A method for producing one or more hydroxide solids, the method comprising:

providing:

a basic catholyte solution comprising an electrolyte;

an acidic anolyte solution; and a neutralization pool comprising an alkaline material;

contacting the basic catholyte solution with a cathode to electrolytically generate hydroxide ions, thereby precipitating the one or more hydroxide solids; and circulating the acidic anolyte solution into the neutralization pool, thereby forming a neutral anolyte solution.

2. The method of claim 1, wherein the electrolyte comprises divalent metal cations.

3. The method of claim 2, wherein the divalent cations comprise $Mg^{2+}$, $Ca^{2+}$, or both $Mg^{2+}$ and $Ca^{2+}$ ions.

4. The method of claim 3, wherein the divalent cations comprise $Mg^{2+}$ ions.

5. The method of claim 1, wherein the basic catholyte solution comprises a brine or sea water.

6. The method of claim 5, wherein the basic catholyte solution comprises sea water.

7. The method of claim 5, wherein the concentration of NaCl in the brine or sea water is about 1,000 ppm or more, about 2,000 ppm or more, about 3,000 ppm or more, about 4,000 ppm or more, about 5,000 ppm or more, about 6,000 ppm or more, about 7,000 ppm or more, about 8,000 ppm or more, about 9,000 ppm or more, about 10,000 ppm or more, about 15,000 ppm or more, about 20,000 ppm or more, about 25,000 ppm or more, or about 30,000 ppm or more, about 35,000 ppm or more, about 40,000 ppm or more, about 45,000 ppm or more, about 50,000 ppm or more, about 55,000 ppm or more, or about 60,000 ppm or more.

8. The method of claim 1, wherein the electrolyte solution has a Ca-equivalent or Mg-equivalent concentration of about 2 ppm or more, about 10 ppm or more, about 50 ppm or more, about 100 ppm or more, about 200 ppm or more, about 300 ppm or more, about 400 ppm or more, about 500 ppm or more, about 600 ppm or more, about 700 ppm or more, about 800 ppm or more, about 900 ppm or more, about 1000 ppm or more, about 1100 ppm or more, about 1200 ppm or more, about 1300 ppm or more, about 1400 ppm or more, or about 1500 ppm or more.

9. The method of claim 1, wherein the one or more hydroxide solids comprise $Mg(OH)_2$ and $Ca(OH)_2$.

10. The method of claim 1, wherein the one or more hydroxide solids comprise $Mg(OH)_2$.

11. The method of claim 1, further comprising removing the one or more hydroxide solids from the surface of the cathode.

12. The method of claim 1, further comprising forming alkalized effluents having a pH greater than 9.

13. The method of claim 12, further comprising forming alkalized effluents having a pH greater than 10.

14. The method of claim 1, wherein the acidic anolyte solution comprises an acid.

15. The method of claim 14, wherein the acidic anolyte solution has a pH of less than about 6.

16. The method of claim 1, further comprising providing a barrier to separate the basic catholyte solution and the acidic anolyte solution.

17. The method of claim 16, wherein the barrier comprises a polymer.

18. The method of claim 1, wherein the alkaline material comprises mafic materials, ultramafic materials, calcium-rich fly ash, slag, or any combination thereof.

19. The method of claim 1, wherein the one or more hydroxide solids comprise $Ca(OH)_2$.

20. A system for the production of one or more hydroxide solids, the system comprising:

an electrolysis reactor comprising:

an electrode assembly disposed within the electrolysis reactor, the electrode assembly comprising:

an anode; and a cathode wherein the anode and the cathode are disposed within the electrode assembly and the anode is in ionic communication with the cathode;

a catholyte chamber in fluid and ionic communication with the cathode;

an anolyte inlet and an anolyte outlet in fluid and ionic communication with the anode; and a neutralization pool, comprising an alkaline material and coupled to the anolyte outlet.

21. The system of claim 20, wherein the electrolysis reactor is a multi-compartment reactor.

22. The system of claim 20, wherein the system further comprises a single-compartment continuous stirred-tank reactor.

23. The system of claim 20, wherein the cathode is a rotating disk cathode.

24. The system of claim 20, wherein the electrolysis reactor is a membrane-less electrolysis reactor.

25. The system of claim 20, wherein the cathode comprises a metallic composition, non-metallic composition, or hybrid metallic and non-metallic composition.

26. The system of claim 20, wherein the cathode comprises stainless steel, titanium oxide, carbon nanotubes, one or more polymers, graphite, or combinations thereof.

* * * * *